US005526598A

United States Patent [19]

Watanabe

[11] Patent Number: 5,526,598

[45] Date of Patent: Jun. 18, 1996

[54] DISPLAY PLATE FOR WIRE-NETTING CAGE

[75] Inventor: Kenichi Watanabe, Yokohama, Japan

[73] Assignee: Tokyo Pet Kabushiki Kaisha, Japan

[21] Appl. No.: 291,099

[22] Filed: Aug. 16, 1994

[30] Foreign Application Priority Data

Aug. 24, 1993 [JP] Japan ..... 5-046065 U

[51] Int. Cl.[6] ..... G09F 3/00

[52] U.S. Cl. ..... 40/308; 40/663; 40/668; 248/222.52; 403/348

[58] Field of Search ..... 40/308, 663, 668, 40/640; 248/222.2, 222.3; 403/348, 349, 350

[56] References Cited

U.S. PATENT DOCUMENTS

| | | | |
|---|---|---|---|
| 2,715 | 7/1842 | Fowler | 248/222.3 X |
| 264,079 | 9/1882 | Griffis et al. | 40/322 |
| 342,194 | 5/1886 | Finnegan et al. | 248/222.3 |
| 3,860,209 | 1/1975 | Strecker | 403/348 X |
| 5,188,324 | 2/1993 | Joseph et al. | 248/222.3 |
| 5,328,289 | 7/1994 | Fussler | 403/348 X |
| 5,395,178 | 3/1995 | Chvojcsek | 403/348 X |

*Primary Examiner*—Brian K. Green
*Attorney, Agent, or Firm*—Graham & James

[57] ABSTRACT

A display plate for a wire-netting cage is composed of a metallic plate member having a circular central opening portion and two opening portions each having a different sectional contour formed therethrough and a display member molded of a synthetic resin while including a circular central protuberance and two protuberances each having a different sectional contour. The metallic plate member is fixedly attached to a front surface of the wire-netting cage by welding it to two vertically extending steel wires. The display member is assembled with the metallic plate member by fitting the central circular protuberance of the display member into the central circular opening portion formed through the metallic plate member and then turning the metallic plate member with the central opening portion as a center. Usually, a display sheet having various items printed thereon is adhesively attached to the front surface of the display member using an adhesive so as to allow the foregoing various items to be visually recognized by a user.

6 Claims, 3 Drawing Sheets

DISPLAY PLATE FOR WIRE-NETTING CAGE

BACKGROUND OF THE INVENTION

1. Field of the Invention

The present invention relates generally to a display plate for a wire-netting cage. More particularly, the present invention relates to a display plate to be firmly or removably attached to a wire-netting cage for accommodating an animal such as a bird(s), a cat(s) or the like wherein various items such as a name of animal, an owner's name, a name of cage's fabricator or a similar item are shown on a display sheet attached to the front surface of a display member molded of a synthetic resin.

2. Description of the Related Art

Conventionally, a wire-netting cage for accommodating an animal therein is constructed such that a plurality of vertically extending steel wires and a plurality of horizontally extending steel wires are crosswise arranged in the equally spaced relationship at a right angle relative to each other, and subsequently, they are fixedly connected to each other at their intersections by employing a spot welding process. To allow items representing the animal accommodated in the wire-netting cage to be visually recognized by a user, a display plate usually molded of a synthetic resin, e.g., a trademark display plate having a trademark, a service mark, a figure mark or a character mark displayed thereon, a name plate having a date of fabrication of the wire-netting cage, specifications given to the wire-netting cage or the like displayed thereon or an explanation plate having instructions for the wire-netting cage to be taken into account in practical use displayed thereon is firmly attached to one of front surfaces of the wire-netting cage by using a thread, a wire or the like.

However, it is not recommendable from the viewpoint of aesthetic appearance of the wire-netting cage that a thread or a metallic wire is used for the purpose of firmly attaching a display plate to the wire-netting cage. In addition, there is a danger that an animal accommodated in the wire-netting cage is unexpectedly injured by a cut end of the metallic wire. Another problem is such that a fastening operation to be achieved by using a thread or a metallic wire takes a long time.

To cope with the foregoing problems, a measure is taken such that a display plate is attached to a front surface of the wire-netting cage, a backup plate having a size larger than that of a mesh size of the wire-netting cage is attached to a rear surface of the wire-netting cage, and subsequently, screws are threadably engaged with the backup plate from the front side of the wire-netting cage by actuating a driver or a similar tool. However, a long time is consumed for threadably attaching the display plate to the wire-netting cage from the front side using screws, and moreover, an extra operation is required for cutting a short part of each screw projected inside of the backup plate for the purpose of preventing an animal from being injured by the projected part of each screw.

In the case that a display plate molded of a synthetic resin is attached to the wire-netting cage, it is practically difficult to immovably hold the display plate on the front surface of the wire-netting cage by using engagement pieces to be secured to horizontally extending steel wires. In addition, since each engagement piece usually molded of a synthetic resin is liable of being broken, deformed or disconnected from the wire-netting cage, it is not suitable to use these engagement pieces for the purpose of firmly attaching the name plate to the wire-netting cage from the front side.

Each of the convectional measures taken for the purpose of fastening the name plate to the wire-netting cage requires many components constituting the wire-netting cage and take a long time. This leads to the result that the wire-netting cage is undesirably fabricated at an expensive cost.

SUMMARY OF THE INVENTION

The present invention has been made in consideration of the aforementioned background.

An object of the present invention is to provide a display plate for a wire-netting cage for accommodating an animal therein wherein the display plate assures that it can simply and reliably be secured to one of front surfaces of the wire-netting cage by any user having no well-trained technique.

Another object of the present invention is to provide a display plate of the foregoing type which can be fabricated at an inexpensive cost.

The present invention provides a display plate to be firmly attached to one of front surfaces of a wire-netting cage, wherein the display plate comprises a metallic plate member having a first circular opening portion formed through the central part thereof and two second opening portions each having a different sectional contour formed on the opposite sides of the first circular opening portion while extending subsequent to the first circular opening portion, the opposite end parts of the metallic plate member being fixedly connected to vertically extending metallic wires each constituting the wire-netting cage by employing a spot welding process; and a display member molded of a synthetic resin and including a first circular protuberance corresponding to the first circular opening portion of the metallic plate member and two second protuberances each having a different sectional contour integrated with the first circular protuberance on the opposite sides of the latter corresponding to the second opening portions of the metallic plate member while extending subsequent to the first circular protuberance, the first circular protuberance being dimensioned to have an outer diameter equal to or slightly smaller than an inner diameter of the first circular opening portion and a height equal to or slightly larger than a thickness of the metallic plate member, and each of the two second protuberances having the same sectional contour as that of each of the two second opening portions and being dimensioned to be equal to or slightly smaller than each of the two second opening portions; whereby in practical use, the first circular protuberance and the two second protuberances of the display member are fitted into the first circular opening portion and the two second opening portions formed through the metallic plate member fixedly welded to the vertically extending metallic wires while the former are positionally aligned with the latter, and subsequently, the display member is turned with a user's hand with the first circular protuberance as a center.

It is preferable that one of the second opening portions formed through the metallic plate member exhibits a semicircular sectional contour and the other one exhibits a substantially square sectional contour.

To assure that the display member is firmly held by the metallic plate member via turning movement of the display member, the two second opening portions formed through the metallic plate member are positionally offset from the vertical line extending through a center of the metallic plate member by an angle of about 15 degrees.

Similarly to the metallic plate member, one of the second protuberances integrated with the first circular protuberance exhibits a semicircular sectional contour and the other one exhibits a substantially square sectional contour.

The display member includes a pair of stoppers molded integral therewith, and the stoppers have slits formed therein on the opposite sides of the metallic plate member. When the display member is turned with a user's hand with the first circular protuberance as a center, each of the stopper members comes in contact with one of the opposite ends of the metallic plate member to receive one corner part of the metallic plate member in the slit thereof.

In addition, the display member includes a pair of stopper projections molded integral with the display member and located substantially opposite to the stoppers at the opposite ends of the metallic plate member. A distance between both the stopper projections is substantially equal to that between both the stoppers. When the display member is turned with a user's hand to come in contact with the slits of the stoppers, causing the stopper projections to be expanded in the outward direction after they are once inwardly bent by the metallic plate member, each of the stopper projections serves to hold a part of the metallic plate portion at the opposite ends of the latter between the stopper projections and the rear surface of the display member in the clamped state.

In addition, a pair of horizontally extending elongated protuberances each having a substantially semicircular sectional contour are formed inside of the metallic plate member toward the wire-netting cage side. Each of the elongated protuberances extends from the opposite ends of the metallic plate member toward the first circular opening portion formed through the metallic plate member in the transverse direction.

For the purpose of conveniences in practical use, various items such as a trademark of goods, a service mark of goods, a company name of goods' fabricator, a commercial name of goods, a model number of goods, an owner's name, description on how to use goods, description of items to be taken into account in practical use of goods or a similar item are shown on the front surface of the display member by employing an embossing process, an impressing process or a printing process.

To assure that the present display member can be exchanged with another one for some reason by turning the display member in the reverse direction, the stopper projections may be eliminated.

Alternatively, a length of each of the stopper projections may be reduced for the same purpose.

Otherwise, each of the stopper projections may have an inclined guide surface adapted to be outwardly expanded for the same purpose.

According to the present invention, the display plate is ready to be in practical use by way of two steps of fitting the first circular protuberance of the display member into the first circular opening portion formed through the metallic plate member and then turning the display member in a clockwise/anticlockwise direction. Thus, the display plate can easily be used for a long time without any possibility that it is disconnected from the wire-netting cage.

Other object, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENT

The present invention will now be described in detail hereinafter with reference to the accompanying drawings which illustrate a preferred embodiment thereof.

Figure 1:
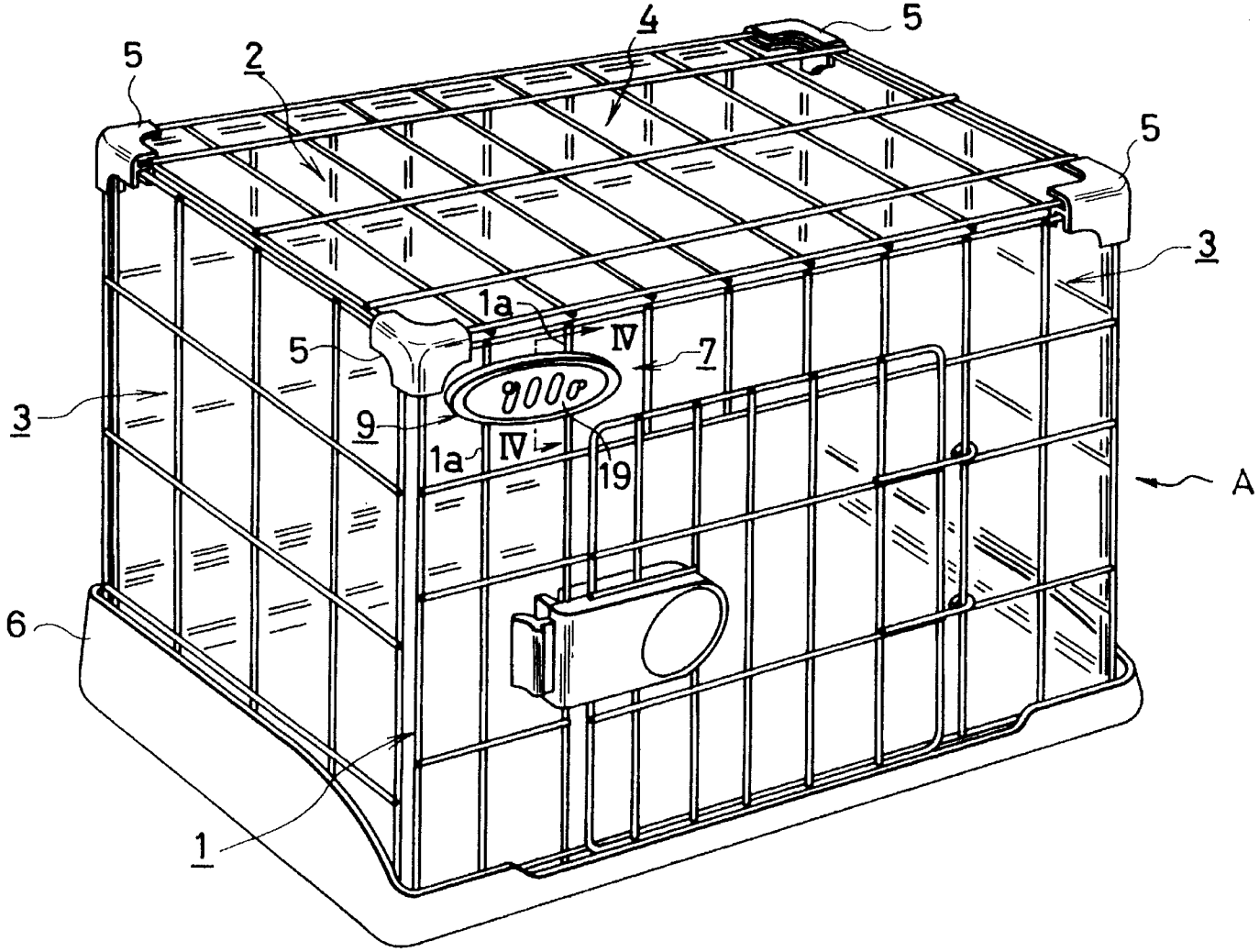
FIG. 1 is a perspective view of a wire-netting cage for accommodating an animal therein wherein a display plate constructed in accordance with an embodiment of the present invention is firmly attached to the front side of the wire-netting cage.

FIG. 1 shows by way of perspective view the structure of a wire-netting cage for accommodating an animal therein wherein a display panel constructed in accordance with the embodiment of the present invention is firmly attached to the front side of the wire-netting cage.

The wire-netting cage generally designated by reference character A is designed in the box-shaped configuration including a front panel 1 having a door removably attached thereto, a top panel 4 and opposite side panels 3 which are connected to each other via corner connectors 5, and an open bottom of the wire-netting cage A is covered with a bottom plate 8 molded of a synthetic resin.

Each of the panels 1 to 4 is constructed such that a plurality of vertically extending steel wires and a plurality of transversely extending steel wires are crosswise arranged at a right angle relative to each other to exhibit a lattice-shaped structure, and moreover, they are integrally connected to each other at their intersections by employing a spot welding process.

In this embodiment, a display plate 7 constructed in accordance with the embodiment of the present invention is attached to the front panel 1 at the left upper corner while it is bridged between two vertically extending wires 1*a*. In the shown case, the display plate 7 is designed in the form of an elliptical plate having a horizontal long axis in such a manner that characters or figures representing various items such as a trademark of goods, a company name of goods' fabricator, a brand name of goods, a classification number of goods or a similar item are displayed on the display plate 7 by employing an embossing process, an impressing process or a printing process.

Figure 2:
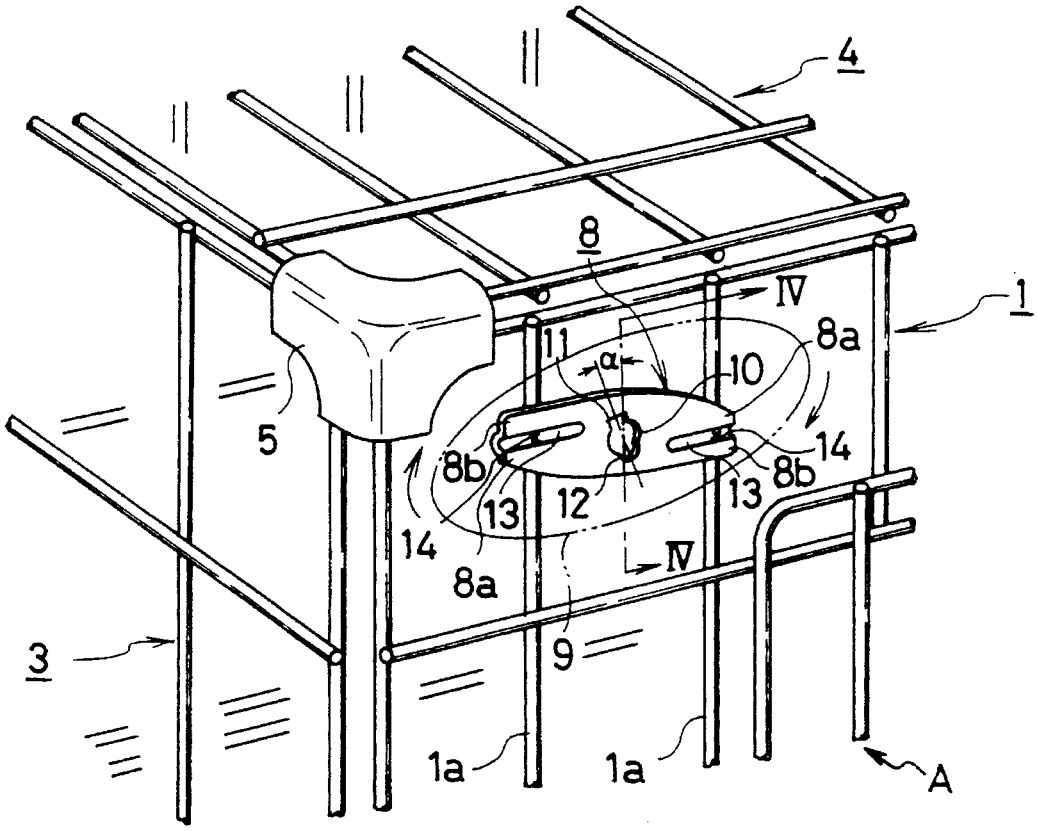
FIG. 2 is a fragmentary enlarged perspective view of the wire-netting cage shown in FIG. 1, particularly showing a metallic plate member for the display plate represented by an elliptical phantom line.
Figure 3:
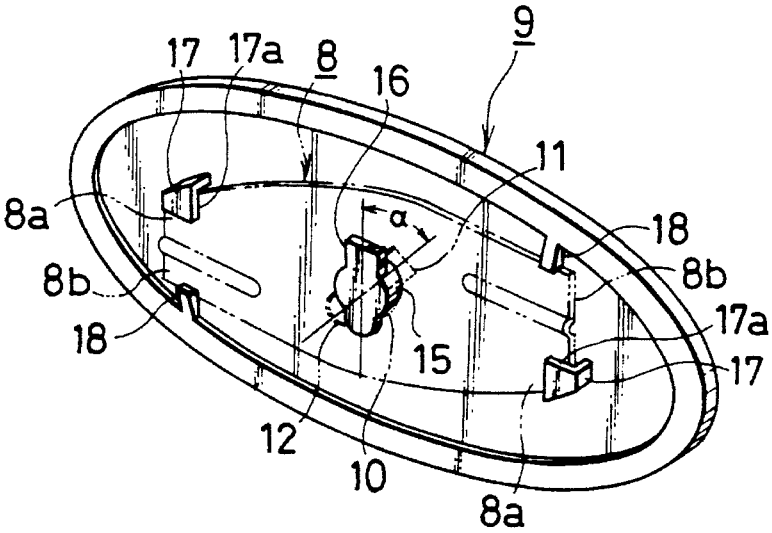
FIG. 3 is an enlarged perspective view of the metallic plate member for the display plate as seen from the rear side.

The display plate 7 is composed of two components, one of them being a metallic plate member 8 as shown in FIG. 2 on an enlarged scale and the other one being a display member 9 molded of a synthetic resin as shown in FIG. 3 on an enlarged scale.

As is best seen in FIG. 2, the metallic plate member 8 is a horizontally extending elongated member of which central part is punched out to form a circular opening portion 10, and a substantially square opening portion 11 is formed through the metallic plate member 8 while extending subsequent to the opening portion 10 in the upward direction. In addition, another semicircular opening portion 12 is formed through the metallic plate member 8 while extending subsequent to the opening portion 10 in the downward direction.

Referring to FIG. 2 again, the opening portions 11 and 12 are located in such a manner as to orient in the leftward oblique direction.

Specifically, while the metallic plate member 8 is fixedly connected to the vertically extending steel wires 1*a* on the front panel 1, the center line extending along the center axes of both the opening portions 11 and 12 is tilted in the leftward direction by an angle relative to the vertical direction.

Linear elongated protuberances 13 extending inward of the opposite ends of the metallic plate member 8 while having a substantially semicircular sectional contour are formed on the latter by employing a press-squeezing process.

The metallic plate member 8 is fastened to the front panel 1 by fixedly connecting the elongated protuberances 13 to the vertically extending wires la at their intersections 14 by employing a spot welding process.

On the other hand, the display member 9 is an article molded of a synthetic resin and having a horizontally extending elongated elliptical contour larger than that of the metallic plate member 8, and a circular protuberance 15 is formed at the central part of the display member 8.

The circular protuberance 15 is dimensioned to have an outer diameter equal to or slightly smaller than an inner diameter of the circular opening portion 10 formed through the metallic plate member 8 as well as a height slightly larger than a thickness of the metallic plate member 8.

A substantially square projection 16 is formed integral with the circular protuberance 15 while extending from the latter in the upward direction.

In addition, a semicircular projection 17 is formed integral with the circular protuberance 15 while extending from the latter in the downward direction.

The substantially square projection 16 and the semicircular projection 17 are dimensioned to be slightly smaller than the substantially square opening portion 11 and the semicircular opening portion 12.

The center line extending along the center axes of both the projections 16 and 17 is positionally coincident with a short axis of the elliptical contour of the display member 9. In the shown case, the center line of the display member 9 is positionally offset from the obliquely extending center line of the metallic plate member 8 by a quantity of angle It is preferable that this angle is set to about 15 degrees.

As shown in FIG. 3, a pair of stoppers 17 are formed at the positions in the vicinity of the opposite ends of the display member 9 on the rear surface side in order to receive one corner 8*a* of each of the opposite ends of the metallic plate member 8 as seen in the transverse direction at the positions in the vicinity of the opposite ends of the display member 9.

Slit portions 17*a* of the stoppers 17' are diametrically parted away from each other on the rear surface of the display member 9 by an angle of 180 degrees, and when the display member 9 is turned in the arrow-marked direction, i.e., in the clockwise direction as seen in FIG. 2 after it is attached to the metallic plate member 8 while the circular projection 15 of the display member 9 is fitted into the circular opening portion 10 formed through the metallic plate member 8, the opposite one corners 8*a* of the metallic plate member 8 are received in the slit portions 17*a* of the stoppers 17' not only without an occurrence of further turning movement of the display member 9 but also without an occurrence of displacement of the display member 9 in the axial direction of the circular projection 15. In addition, a pair of stopper projections 18 are formed integral with the display member 9 at the positions substantially opposite to the stoppers 17 in order to prevent the display member 9 from being turned in the reverse direction.

Each of the stopper projections 18 is designed in the form of a rib having an inclined surface of which height increases toward the stopper 17, i.e., in the inward direction more and more.

A distance between each stopper projection 18 and each stopper 17 is dimensioned to be equal to a width of each of the opposite ends of the metallic plate member 8.

With this construction, when the corners 8*a* of the metallic plate member 8 are received in the slit portions 17*a* of the stoppers 17', causing further turning movement of the display member 9 to be prevented, corners 8*b* located opposite to the corners 8*a* climb on the stopper projections 18, and subsequently, the stopper projections 18 are expanded in the outward direction to hold the metallic plate member 8 between the stopper projections 18 and the rear surface of the display member 9 in the clamped state.

Next, a method of attaching the display plate 7 of the present invention to the wire-netting cage A will be described below.

As shown in FIG. 2, first, the metallic plate member 8 is brought in contact with the front panel 1 at a desired position on the wire-netting cage A.

At this time, while the metallic plate member 8 is held with a horizontal attitude, the elongated protuberances 13 on the rear surface of the metallic plate member 8 are crosswise brought in contact with the vertically extending steel wires 1*a* at a right angle relative to the elongated protuberances 13. While the foregoing state is maintained, the elongated protuberances 13 are fixedly connected to the vertically extending steel wires la at two intersections 14 by employing a spot welding process, whereby the metallic plate member 8 is immovably attached to the front panel 1 of the wire-netting cage A.

Next, the display member 9 is attached to the metallic plate member 8.

To this end, first, the display member 9 is caused to come near to the metallic plate member 8 with a slantwise attitude, and subsequently, the protuberances 16 and 17 on the display member 9 are fitted into the opening portions 11 and 12 formed through the metallic plate member 8.

After the display member 9 is sufficiently thrusted against the metallic plate member 8 to assume the state that the circular protuberance 15 is completely fitted into the circular opening portion 10, the display member 9 is turned with a user's hand in the clockwise direction as seen in FIG. 2, causing the corners 8*a* on the opposite ends of the metallic plate member 8 to be immovably received in the slit portions 17*a* of the stoppers 17'.

At this time, the corners 8*b* located on the opposite side of the corners 8*a* climb over the stopper projections 18, and subsequently, the stopper projections 18 are expanded in the outward direction so as to allow the metallic plate member 8 to be held between the stopper projections 18 and the rear surface of the display member 9 in the clamped state.

Consequently, there does not arise a malfunction that the display member 9 is turned in the reverse direction. The foregoing method of attaching the display member 9 to the front panel 1 of the wire-netting cage A can simply be achieved merely by turning the display member 9 by an angle of 15 degrees, and moreover, the display member 9 can fixedly be attached to the front panel 1 of the wire-netting cage A at a predetermined position on the front panel 1 at a high accuracy.

While the display member 9 is firmly attached to the metallic plate member 8, the central part of the display member 9 as well as the opposite ends of the same are fixedly secured to the metallic plate member 8 without any possibility that they move in the axial direction (i.e., in the forward/rearward direction), resulting in the metallic plate member 8 and the display member 9 being reliably connected to each other.

In the case of the display plate for the wire-netting cage constructed in accordance with the embodiment of the present invention as described above, it is recommendable that a display sheet 19 having various items such as a trademark of goods, a service mark of goods, a commercial name of goods, a brand name of goods, a figure representing the brand name, a figure representing a family to which goods belong, a name of goods' fabricator, a model number of goods, specifications given to goods, brief description on how to use goods, description on items to be taken into account in practical use of goods or a similar item printed thereon is adhesively attached to the front surface of the display member 9 by using an adhesive.

Figure 4:
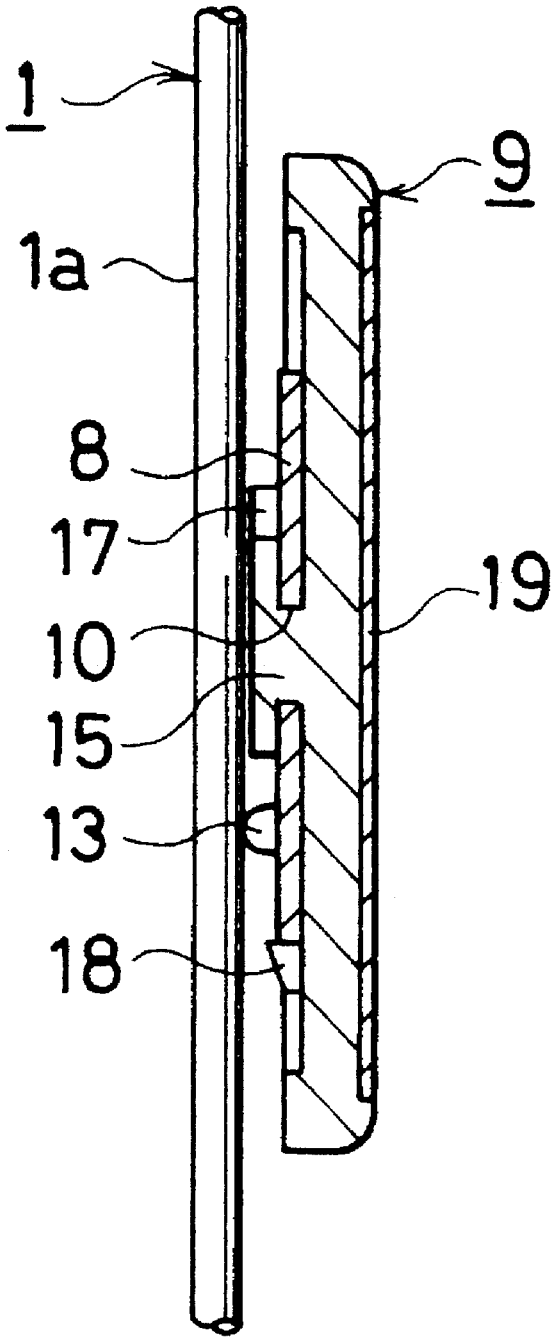
FIG. 4 is a sectional view of the display plate taken along line IV—IV in FIG. 2, particularly showing that a display sheet is adhesively attached to the front surface of a display member for the display plate.

FIG. 4 shows by way of sectional view how the display sheet 19 is adhesively attached to the display member 9. However, representation of these items on the display member 9 should not be limited only to the case that the display sheet 19 is adhesively attached to the display member 9. Alternatively, these items may be shown directly on the display member 9 by employing an embossing process, an impressing process or a printing process.

In addition, a name of the animal accommodated in the wire-netting cage A can be shown on the display sheet 19. In this case, it is desirable that the sheet 19 can freely be exchanged with another one every time the kind of animals to be accommodated in the wire-netting cage A is changed to other one. Otherwise, the display member 9 may freely be detached from the metallic plate member 8 in accordance with a modified embodiment to be described below.

In this modified embodiment, the stopper projections 18 to be engaged with the metallic plate member 8 are eliminated. Alternatively, a height of each stopper projection 18 may be reduced. Otherwise, inclined guide surfaces each having reverse inclination may be formed on the rear surface side of the display member 9 so as to enable the display member 9 to be turned in the reverse direction for the purpose of disconnecting the display member 9 from the metallic plate member 8.

As is apparent from the above description, according to the present invention, advantages as noted below can be obtained with the display plate constructed in the above-described manner.

Firstly, a display plate having a comparatively large surface area can simply be attached to the wire-netting cage without any possibility that it can not be disconnected from the metallic plate member.

Secondly, the displace plate is simple in structure, and moreover, it can be constructed with a minimum number of components.

Thirdly, the display plate can be disconnected from the metallic plate member as desired.

While the present invention has been described above with respect to a single preferred embodiment thereof, it should of course be understood that the present invention should not be limited only to this embodiment but various change or modification may be made without any departure from the scope of the present invention as defined by the appended claims.

What is claimed is:

1. A display plate for a wire-netting cage, comprising:

a metallic plate member having a first circular opening portion formed through a central part thereof and having two second opening portions each having a different sectional contour formed on opposite sides of said first circular opening portion while extending subsequent to said first circular opening portion, opposite ends parts of said metallic plate member for being fixedly connected to said wire-netting cage by employing a spot welding process, and a display member molded of a synthetic resin and including a first circular protuberance corresponding to said first circular opening portion of said metallic plate member and two second protuberances each having a different sectional contour integrated with said first circular protuberance on opposite sides of said first circular protuberance corresponding to said two second opening portions of said metallic plate member while extending subsequent to said first circular protuberance, said first circular protuberance being dimensioned to have an outer diameter equal to or slightly smaller than an inner diameter of said first circular opening portion and a height equal to or slightly larger than a thickness of said metallic plate member, and each of said two second protuberances having the same sectional contour as that of each of said two second opening portions and being dimensioned to be equal to or slightly smaller than each of said two second opening portions, whereby in practical use, said first circular protuberance and two second protuberances of said display member are fitted into said first circular opening portion and said two second opening portions formed through said metallic plate member for being fixedly welded to said wire-netting cage, and said display member is turned with a user's hand with said first circular protuberance as a center, wherein said display member includes a pair of stoppers molded integral therewith, said stoppers having slits formed therein on the opposite sides of said metallic plate member, each of said stoppers coming in contact with one of the opposite ends of said metallic plate member to receive one corner of said metallic plate member in said slit thereof when said display member is turned with a user's hand with said first circular protuberance as a center.

2. The display plate as claimed in claim 1, wherein said display member includes a pair of stopper projections molded integral with said display member and located substantially opposite to said stoppers at the opposite ends of said metallic plate member, a distance between said pair of stopper projections being substantially equal to that between said pair of stoppers, and when said metallic plate member is turned with a user's hand to come in contact with said slits of said stopper, causing said stopper projections to be expanded in the outward direction after they are once inwardly bent by said metallic plate member, each of said stopper projections serving to hold a part of said metallic plate member at the opposite ends of said metallic plate member between said stopper projections and the rear surface of said display member in the clamped state.

3. The display plate as claimed in claim 2, wherein said stopper projections are eliminated so as to enable said display member to be exchanged with another one by turning said display member in a reverse direction

4. The display plate as claimed in claim 2, wherein a length of each of said stopper projections is reduced so as to enable said display member to be exchanged with another one by turning said display member in a reverse direction

5. The display plate as claimed in claim 2, wherein each of said stopper projections has an inclined guide surface adapted to be outwardly expanded so as to enable said display member to be exchanged with another one after said display member is turned in a reverse direction.

6. A display plate for a wire-netting cage, comprising:

a metallic plate member having a first circular opening portion formed through a central part thereof and having two second opening portions each having a different sectional contour formed on opposite sides of said first circular opening portion while extending subsequent to said first circular opening portion, opposite ends of said metallic plate member for being fixedly connected to said wire-netting cage by employing a spot welding process, and a display member molded of a synthetic resin and including a first circular protuberance corresponding to said first circular opening portion of said metallic plate member and two second protuberances each having a different sectional contour integrated with said first circular protuberance on opposite sides of said first circular protuberance corresponding to said two second opening portions of said metallic plate member while extending subsequent to said first circular protuberance, said first circular protuberance being dimensioned to have an outer diameter equal to or slightly smaller than an inner diameter of said first circular opening portion and a height equal to or slightly larger than a thickness of said metallic plate member, and each of said two second protuberances having the same sectional contour as that of each of said two second opening portions and being dimensioned to be equal to or slightly smaller than each of said two second opening portions, whereby in practical use, said first circular protuberance and said two second protuberances of said display member are fitted into said first circular opening portion and said two second opening portions formed through said metallic plate member for being fixedly welded to said wire-netting cage, and said display member is turned with a user's hand with said first circular protuberance as a center, wherein a pair of horizontally extending elongated protuberances each having a substantially semicircular sectional contour are formed inside of said metallic plate member toward the wire-netting cage side, said elongated protuberances extending from the opposite ends of said metallic plate member toward said first circular opening portion of said metallic plate member in a traverse direction.

* * * * *